US011866228B2

(12) United States Patent
Plourde

(10) Patent No.: US 11,866,228 B2
(45) Date of Patent: Jan. 9, 2024

(54) METHODS FOR FORMING AND OPENING CHILD-RESISTANT RECLOSABLE BAGS

(71) Applicant: Illinois Tool Works Inc., Glenview, IL (US)

(72) Inventor: Eric Plourde, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/969,780

(22) Filed: Oct. 20, 2022

(65) Prior Publication Data

US 2023/0150731 A1 May 18, 2023

Related U.S. Application Data

(60) Provisional application No. 63/279,348, filed on Nov. 15, 2021.

(51) Int. Cl.
*B65D 33/25* (2006.01)
*B65B 61/18* (2006.01)

(52) U.S. Cl.
CPC ..... *B65D 33/2584* (2020.05); *B65B 61/188* (2013.01); *B65D 33/255* (2013.01)

(58) Field of Classification Search
CPC ..... B65D 33/25; B65D 33/2508; B65D 33/2516; B65D 33/2525; B65D 33/2533; B65D 33/2541; B65D 33/255; B65D 33/2558; B65D 33/2566; B65D 33/2575; B65D 33/2583; B65D 33/2584; B65D 33/2585; B65D 33/2586; B65D 33/25865; B65D 33/2587; B65D 33/2588; B65D 33/2589; B65D 33/259; B65D 33/2591
USPC ..... 383/61.1, 63–65
See application file for complete search history.

(56) References Cited

U.S. PATENT DOCUMENTS

| | | | | |
|---|---|---|---|---|
| 10,099,818 | B2 | 10/2018 | Sprehe | |
| 10,118,737 | B2 | 11/2018 | Septien Rojas | |
| 10,427,839 | B2 | 10/2019 | Johnston | |
| 10,689,162 | B2 | 6/2020 | Tameda | |
| 2014/0270585 | A1* | 9/2014 | Heckman | B65D 33/2508 493/210 |
| 2018/0257820 | A1* | 9/2018 | Tameda | B65D 33/08 |
| 2018/0273257 | A1 | 9/2018 | Kirsh | |

FOREIGN PATENT DOCUMENTS

WO WO-2019016553 A1 * 1/2019

* cited by examiner

*Primary Examiner* — Jes F Pascua
*Assistant Examiner* — Nina K Attel
(74) *Attorney, Agent, or Firm* — Joseph M. Butscher; The Small Patent Law Group, LLC

(57) ABSTRACT

A child-resistant reclosable bag includes a container configured to retain one or more items within a product portion. A zipper is coupled to the container. The zipper is above the product portion. The zipper includes one or more primary seals, and one or more secondary seals at one or more defined locations. The one or more secondary seals at the one or more defined locations identify opening areas on the product portion. The opening areas are configured to be grasped and pulled apart to open the zipper.

20 Claims, 3 Drawing Sheets

METHODS FOR FORMING AND OPENING CHILD-RESISTANT RECLOSABLE BAGS

CROSS-REFERENCE TO RELATED APPLICATIONS

This application claims priority to U.S. Provisional Application No. 63/279,348, filed Nov. 15, 2021, which is hereby incorporated by reference in its entirety.

BACKGROUND

Technical Field

The subject matter described herein relates to child-resistant reclosable bags, and more particularly to methods for forming and opening child-resistant reclosable bags.

Discussion of Art

Child-resistant reclosable bags are used to hold items, such as medicinal capsules, detergent capsules, *cannabis* products, and/or the like. Such items may be attractive, but harmful, to a child.

Certain packages include plastic lids, which, in order to be removed from a glass or plastic container, are squeezed or pushed in various ways which may not be apparent to a child, and/or beyond the strength capabilities of the child. However, such containers are complicated to manufacture and add a considerable expense to a finished product. Additionally, such containers may be heavy and bulky, which adds to a cost of transportation. Moreover, the weight and bulk adds to a recycling burden of these products.

A known child-resistant reclosable bag includes a seal above locking elements of a two-piece zipper on one zipper half and only below the locking elements on the other zipper half. As such, the bag can be put into a shear mode that is extremely difficult to open when simply pulling the top of the flexible package open as would be done for a typical reclosable flexible package, as described in U.S. Pat. No. 10,118,737, entitled "Child-Resistant Reclosable Bags" (the "737 Patent"), which is hereby incorporated by reference in its entirety. Various devices for opening such packages have been developed. For example, the 737 Patent describes a complete, but unattached upper flange. As another example, small, graspable tabs are engaged in order to open the closure.

Certain known packages include a two-piece zipper closure in a flexible package. Such packages are configured to be opened by exerting a force in relation to the locking elements from below (that is, the product side) the locking elements. Examples of such enclosures are disclosed in the 737 Patent, U.S. Pat. No. 10,689,162, entitled "Bag with Zipper Tape," U.S. Pat. No. 10,427,839, entitled "Resealable Bag," U.S. Pat. No. 10,099,818, entitled "Reclosable Zipper Having Child Resistant Features," and United States Patent Application Publication 2018/0273257, entitled "Child Resistant Sealing System."

However, it has been found that packages as disclosed in these references may be too easily opened by simply tugging on flaps and other parts of the bag below the locking elements.

BRIEF DESCRIPTION

A need exists for a child-resistant reclosable bag that is more difficult for children to open. Further, a need exists for a child-resistant reclosable bag having a smaller area configured to be engaged for opening the bag, in contrast to any location across the width of the bag.

With those needs in mind, certain embodiments of the present disclosure provide a child-resistant reclosable bag, including a container configured to retain one or more items within a product portion. A zipper is coupled to the container. The zipper is above the product portion. The zipper includes one or more primary seals, and one or more secondary seals at one or more defined locations. The one or more secondary seals at the one or more defined locations identify opening areas on the product portion. The opening areas are configured to be grasped and pulled apart to open the zipper. In a least one embodiment, the zipper is disposed between the product portion and a consumer portion.

In at least one example, the one or more primary seals extend along an entire width of the container, and the one or more secondary seals extend along less than the entire width of the container.

In at least one embodiment, the opening areas are below the zipper. In at least one example, at least one of the opening areas is directly below the one or more secondary seals and the one or more primary seals. As a further example, the at least one of the opening area is directly underneath a center of the one or more secondary seals.

In at least one example, the opening areas have a first width. The one or more secondary seals have a second width. As a further example, the first width equals the second width.

In at least one embodiment, the opening areas include a first opening area on a first face of the container on the product portion, and a second opening area on a second face of the container on the product portion. As an example, the first opening area is directly across from the second opening area.

In at least one embodiment, opening indicia designate or otherwise indicate the opening areas. As an example, the one or more secondary seals include the opening indicia.

Certain embodiments of the present disclosure provide a method of forming a child-resistant reclosable bag. The method includes coupling a zipper to a container that is configured to retain one or more items within a product portion, wherein the zipper is above the product portion, and wherein the zipper comprises one or more primary seals and one or more secondary seals at one or more defined locations; and identifying, by the one or more secondary seals, opening areas on the product portion, wherein the opening areas are configured to be grasped and pulled apart to open the zipper.

BRIEF DESCRIPTION OF THE DRAWINGS

The inventive subject matter may be understood from reading the following description of non-limiting embodiments, with reference to the attached drawings, wherein below.

DETAILED DESCRIPTION

Certain embodiments of the present disclosure provide a child-resistant reclosable bag that can be devoid of cut zipper tabs. Zipper tabs can be difficult to operate, and typically result in scrap during manufacturing. Moreover, certain embodiments of the present disclosure provide a child-resistant reclosable bag that allows for an opening feature and location to be incorporated during bag fabrication, thereby allowing registration with the pouch, in contrast to a random location of tabs.

Figure 1:
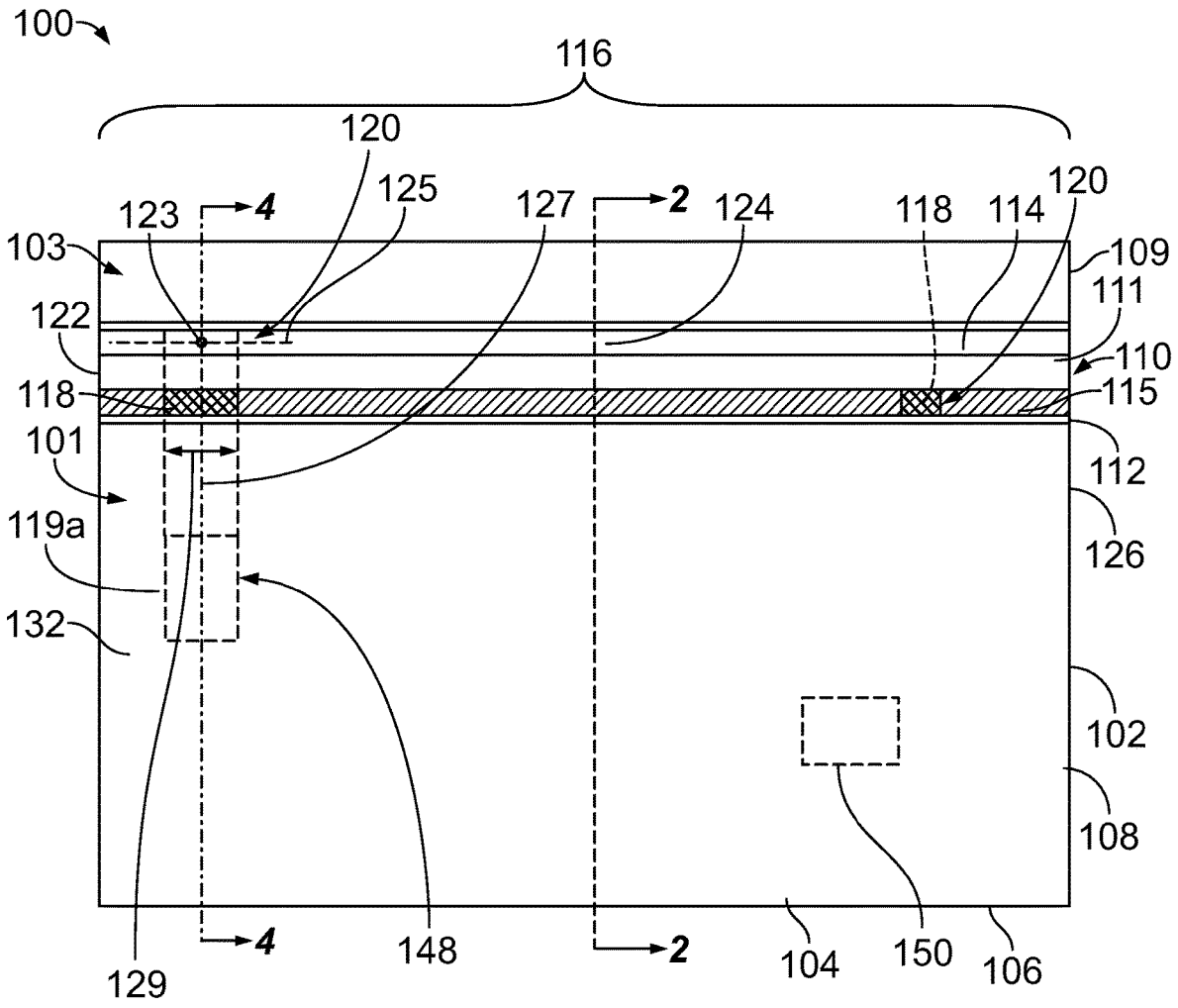
FIG. 1 illustrates a lateral view of a child-resistant reclosable bag, according to an embodiment of the present disclosure.

FIG. 1 illustrates a lateral view of a child-resistant reclosable bag 100, according to an embodiment of the present disclosure. The bag 100 includes a container 102, such as a flexible pouch, package, bag, or the like, configured to hold one or more items (not shown) in a product portion 101 below a zipper 110. In at least one embodiment, the bag 100 is formed of one or more flexible and resilient polymers.

The container 102 includes a sealed base 104 at a bottom end 106, flexible walls 108 extending upwardly from the base 104, and a top end 109. A zipper 110 is coupled to the container 102 and is disposed proximate the top end 109. The zipper 110 is configured to allow the bag 100 to be selectively opened and closed. The zipper 110 includes opposed locking elements 111 on either face of the bag 100 that are configured to selectively mate with one another, as is known.

The product portion 101 (for example, an end or side, depending on the orientation of the bag 100) is defined below the zipper 110. A consumer portion 103 (for example, an end or side, depending on the orientation of the bag 100) is defined above the zipper 110. The product portion 101 is configured to retain a product between the zipper 110, the base 104, and the flexible walls 108.

The zipper 110 further includes a lower flange 112 below the locking elements 111, and an upper flange 114 above the locking elements 111. A primary seal 115 is disposed on the lower flange 112 (lower flange 112*b* in FIG. 4). The primary seal 115 extends across a width 116 of the bag 100. A secondary seal 118 is disposed on an opposed lower flange 112 (lower flange 112*a* in FIG. 4). The secondary seal 118 is separate and distinct from the primary seal 115. As shown, the primary seal 115 and the secondary seal 118 can be on one face, such as the face 132 of the bag 100. Optionally, an opposite face may not include a secondary seal or a primary seal. In at least one embodiment, the primary seal 115 sealingly couples to the face 132 from the lower flange 112, the secondary seal 118 sealingly couples to the face 132 from the lower flange 112, and another primary seal couples to an opposite face (such as the face 130 shown in FIGS. 2-4) from a lower flange.

The secondary seal 118 is located at a defined location 120 of the upper flange 114. The secondary seal 118 extends along only a portion of the width 116. For example, the secondary seal 118 is located proximate to a side 122 of the bag 100. As shown, the secondary seal 118 is offset from the side 122 toward a middle 124 of the upper flange 114. In at least one embodiment, the secondary seal 118 does not extend to the middle 124 of the upper flange 114. Instead, the secondary seal 118 is closer to the side 122 of the bag 100 than the middle 124 of the upper flange 114.

In at least one embodiment, the secondary seal 118 is substantially shorter than the primary seal 115. For example, the secondary seal 118 can be less than half the length of the primary seal 115. In at least one embodiment, the secondary seal 118 is less than 25% of the length of the primary seal 115. For example, the secondary seal 118 can be between 5-10% the length of the primary seal 115. By making the secondary seal 118 substantially shorter than the primary seal 115, and locating it away from the side 122 and the middle 124, the likelihood of a child engaging the secondary seal 118 is reduced.

As shown, the secondary seal 118 is proximate to the side 122. Optionally, the secondary seal 118 can be located proximate to the side 126, which is opposite from the side 122.

In at least one embodiment, the bag 100 includes only one secondary seal 118 at a location that a child may not intuitively grasp. In at least one other embodiment, the bag 100 includes at least one other secondary seal 118. For example, the bag 100 can include a secondary seal 118 proximate to the side 122, and a secondary seal 118 at a defined location 120 proximate to the side 126. As another example, the bag 100 can include three or more secondary seals.

The bag 100 is configured to be opened by grasping an opening area 119*a* below the secondary seal 118 on the product portion 101 of the bag 100. In at least one embodiment, the opening area 119*a* is directly below (or optionally offset from) the secondary seal 118 and the primary seal 115. For example, the opening area 119*a* can be directly (or optionally, offset) underneath a center 123 of the secondary seal 118 (and optionally, the primary seal 115). As an example, the secondary seal 118 has a longitudinal axis 125 extending along a length of the zipper 110 above the primary seal 115. The opening area 119*a* extends through an axis 127 that is orthogonal (that is, at a right angle) to the longitudinal axis 125.

The opening area 119*a* (and an opening area 119*b*, as described herein) can be spaced apart from the primary seal 115, underneath the secondary seal 118 and the primary seal 115. For example, the opening area 119*a* can be between 1-3 inches below the primary seal 115. Optionally, the opening area 119*a* can be less than 1 inch below the primary seal 115, or greater than 3 inches below the primary seal 115.

In at least one embodiment, the opening area 119*a* is the same width 129 as the secondary seal 118. Optionally, the opening area 119*a* can have a width that is greater than (for example, 5-10% greater), or less than (for example, 5-10% less than) the width 129 of the secondary seal 118.

As described herein, in order to open the bag 100, the opening area 119*a* on a face 132 of the bag 100 on the product portion 101 is grasped, and an opening area 119*b* (shown in FIG. 4) is grasped. The opening area 119*b* is directly opposite from the opening area 119*a* on an opposite face 130 of the bag 100 on the product portion 101. The opening areas 119*a* and 119*b* are grasped and pulled apart from one another, thereby allowing the zipper 110 to be opened.

In at least one embodiment, at least one of the opening areas 119*a* and/or 119*b* can be designated by opening indicia 148. The opening indicia 148 can be or otherwise include a colored region, a shaded region, a text or graphic message, a textured region (such as a roughened, embossed, or the like surface), and/or the like. The indicia 148 denote the area(s)

119*a* and/or 119*b* to be grasped to open the bag 100. Optionally, the bag 100 may not include the opening indicia 148.

In at least one embodiment, the opening indicia 148 can be on the secondary seal 118. For example, the opening indicia 148 can be a graphic or text shown on the secondary seal 118 and/or a portion of the container 102 directly secured to the secondary seal 118. As an example, the opening indicia 148 can be or otherwise include an arrow pointing downward on the secondary seal 118 and/or the container 102. As another example, the opening indicia 148 can be a message such as "below" or "down" on the secondary seal 118 and/or the container 102.

As described herein, the child-resistant reclosable bag 100 includes the container 102 configured to retain one or more items within the product portion 101. The zipper 110 is coupled to the container 102. The zipper 110 is above the product portion 101. The zipper 110 is disposed between the product portion 101 and the consumer portion 103. The zipper 110 includes one or more primary seals 115, and one or more secondary seals 118 at one or more defined locations 120. The one or more secondary seals 118 at the one or more defined locations 120 identify opening areas 119*a* and 119*b* on the product portion 101. The opening areas 119*a* and 119*b* are configured to be grasped and pulled apart to open the zipper 110.

Figure 2:
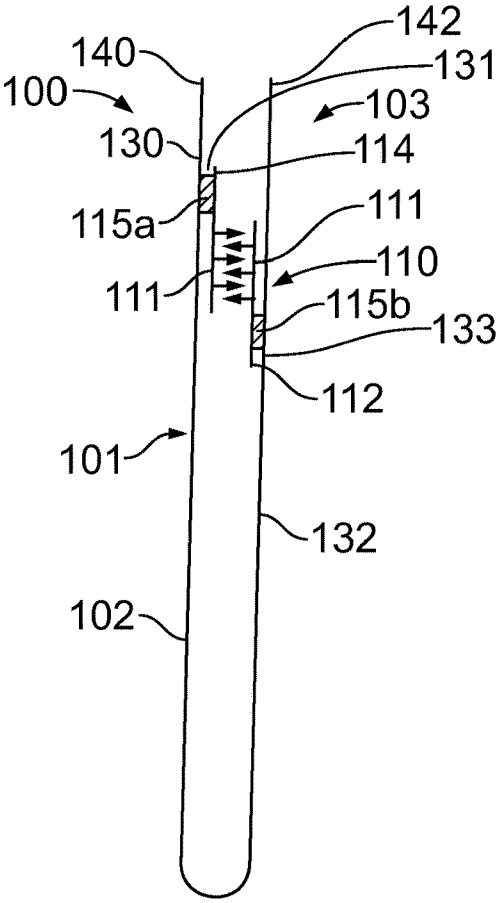
FIG. 2 illustrates a cross-sectional view of the child-resistant reclosable bag of FIG. 1 through line 2-2.

FIG. 2 illustrates a cross-sectional view of the child-resistant reclosable bag 100 of FIG. 1 through line 2-2. In at least one embodiment, the zipper 110 includes the upper flange 114 having a first primary seal 115*a* extending along the face 130, such as a first face, of the container 102, and the lower flange 112 having a second primary seal 115*b* extending along the face 130, such as second face, opposite from the first face 130, of the container 102. It is to be understood that the first face 130 may be considered the second face, and the second face 132 may be considered the first face. The terms first and second, for example, are merely to indicate numbers of faces, for example, and are not to limit the identity of the faces, for example.

As shown, the opening areas 119*a* and 119*b* are not shown in FIG. 2, as the secondary seal 118 (shown in FIG. 1) is not shown in FIG. 2. As described, the opening areas 119*a* and 119*b* are located at areas that are aligned with and below the secondary seal 118.

Figure 3:
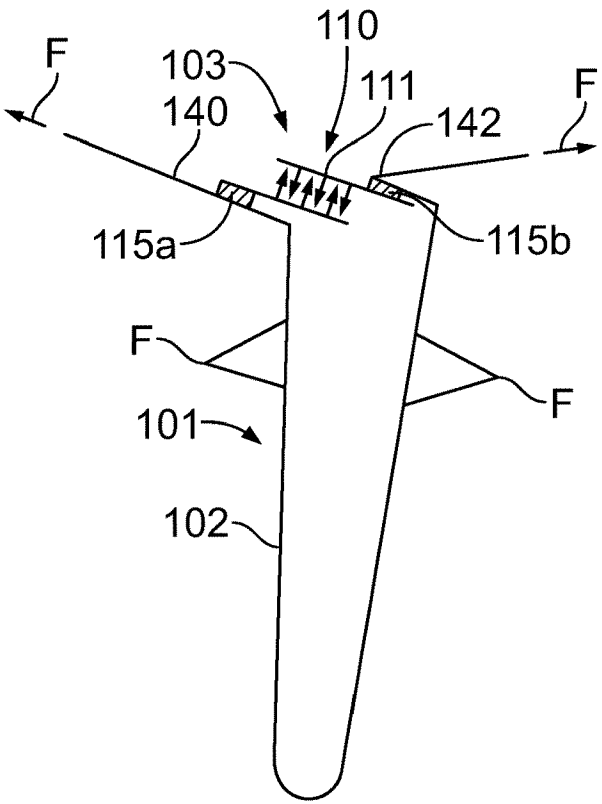
FIG. 3 illustrates a cross-sectional view of the child-resistant reclosable bag of FIG. 2 having opposed forces applied thereto.

FIG. 3 illustrates a cross-sectional view of the child-resistant reclosable bag 100 of FIG. 2 having opposed forces F applied thereto. Referring to FIGS. 2 and 3, the upper flange 114 can be coupled to just the second face 132 of the container 102, and the lower flange 112 can be coupled to just the first face 130 of the container 102 (or vice versa). Optionally, the zipper 110 can include an upper flange and a lower flange coupled to both the first face 130 and the second face 132. As shown, the seal 115*a* extends away from the upper flange 114 and sealingly engages an inner surface 131 of the container 102. Similarly, the seal 115*b* extends away from the lower flange 112 and sealingly engages an inner surface 133 of the container 102. As shown in FIG. 3, in particular, when the upper ends 140 and 142 of the opposite faces 130 and 132, respectively, are grasped and pulled with opposed forces F, the bag 100 is forced into a shear mode, making it extremely difficult to pull the closure halves apart.

Similarly, if areas below the zipper 110 are grasped and pulled apart with opposed forces F, the bag 100 is also forced into a shear mode, thereby increasing the difficulty in opening the bag 100. In general, when forces are applied to the bag 100 at the product portion 101 or the consumer portion 103 as shown in FIG. 3, the bag 100 becomes skewed into an orientation that results in the locking elements 111 being put into a shear mode, which makes unlocking the opposed locking elements 111 difficult.

Figure 4:
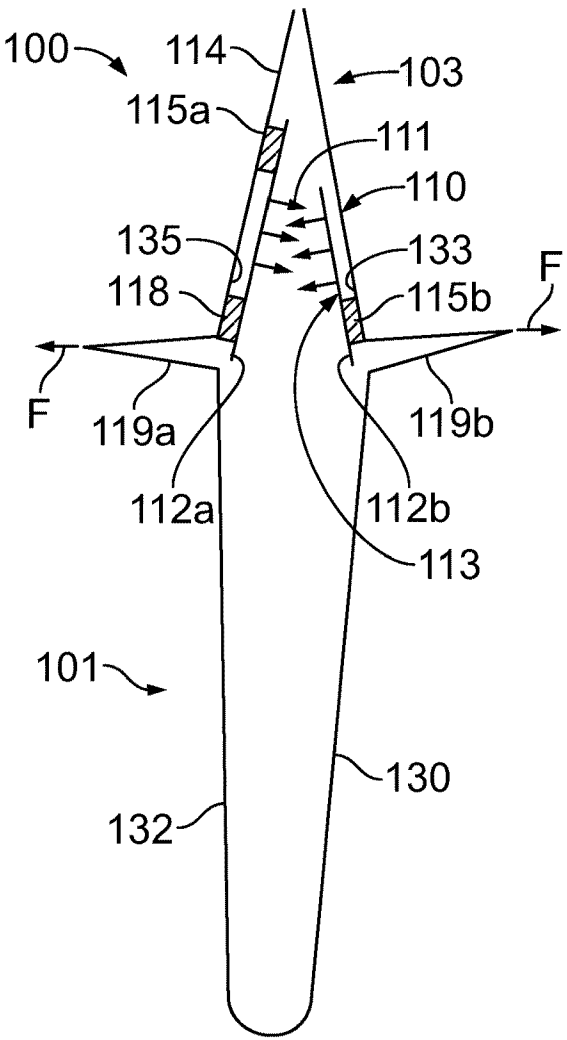
FIG. 4 illustrates a cross-sectional view of the child-resistant reclosable bag of FIG. 1 having opposed forces applied thereto.

FIG. 4 illustrates a cross-sectional view of the child-resistant reclosable bag 100 of FIG. 1 having opposed forces F applied thereto. As shown in FIG. 4, the secondary seal 118 extends away from the lower flange 112*a* and sealingly engages an inner surface 135 of the container 102 below the locking elements 111 of the zipper 110. The secondary seal 118 can be on the second face 132, or optionally the first face 130. In at least one other embodiment, a secondary seal 118 can be on the first face 130, and another secondary seal 118 can be on the second face 132.

In at least one embodiment, the secondary seal 118 is at a height on the container 102 that is at least the same as a top 113 of the locking elements 111. In at least one embodiment, the secondary seal 118 can be at the same height as a lower portion of the locking elements 111. In at least one other embodiment, the secondary seal 118 is above the locking elements 111.

The consumer portion 103 extends above the zipper 110, and the product portion 101 extends below the zipper 110. The opening area 119*a* is on the face 132, and the opening area 119*b* is on the face 130. The opening areas 119*a* and 119*b* are directly across from one another.

When the bag 100 is grasped at the opening areas 119*a* and 119*b* underneath the secondary seal 118 and the primary seal 115*a* (such as by fingers of an individual) below the zipper 110, and a separating force F is applied thereto, the container 102 is put into a typical peel mode, and is able to be opened. Once the opening of the closure is initiated in the opening areas 119*a* and 119*b*, the force F can easily be propagated across the entire width of the container 102, thereby allowing the container 102 to be opened.

As such, in order to open the container 102, an individual first grasps the opening areas 119*a* and 119*b* below the secondary seal 118. The separating force F is then applied at the opening areas 119*a* and 119*b*, which then allows the bag 100 to be opened.

In at least one embodiment, the secondary seal 118 and/or the opening areas 119*a* and 119*b* can be coded to indicate their identities. For example, the secondary seal 118 and/or the opening areas 119*a* and/or 119*b* can be color coded. As another example, the secondary seal 118 and/or the opening areas 119*a* and/or 119*b* can be identified with text. As another example, the secondary seal 118 and/or the opening areas 119*a* and/or 119*b* can be identified through a tactile feature, such as a dimple, bump, protuberance, or the like.

Referring again to FIG. 1, the bag 100 can include indicia 150 for instructions on opening. For example, the indicia 150 can be printed, adhered, or the like to a face 130 and/or 132 of the container 102. The indicia 150 can be or include text, graphics, or the like that provide instructions for opening the bag 100 (that is, applying the force F at the defined opening areas 119*a* and 119*b* first).

As described herein, the bag 100 takes advantage of well understood shear versus peel forces on a two piece zipper enclosure. The bag 100 greatly reduces necessary force applied at an initial opening area (that is, the opening areas 119*a* and 119*b*) in contrast to certain known child-resistant reclosable bags.

The opening areas 119*a* and 119*b* below the secondary seal 118 provide the locations for initial engagement of force to open the bag 100. The opening areas 119 and 119*b* identified by the secondary seal 118 (in particular, the opening areas 119*a* and 119*b* are below the secondary seal 118) are locations that are configured to be first engaged to peel open the bag 100 and disengage the opposed locking elements 111 of the zipper 110 from one another. There is no need for cutting tabs to provide such locations. As such, scrap during manufacturing is reduced. The secondary seal 118 can be formed on the container 102 as the container 102 is formed, and easily registered with the container 102. That is, the secondary seal 118 can be integrally formed with the container 102 as the container 102 is being formed.

Referring to FIGS. 1 and 4, the secondary seal 118 identifies a localized modified area of the bag 100 where the shear effect is eliminated. The secondary seal 118 is a small, localized seal proximate to the consumer portion 103 of the bag 100, but which identifies the opening areas 119*a* and 119*b* below the zipper 110 on the product portion 101 of the bag 100. With the secondary seal 118 in place, the forces F applied below the zipper 110 at the opening areas 119*a* and 119*b* cause the opposed locking elements 111 of the zipper 110 to be put into a peel mode, thereby making the zipper 110 easy to open.

Figure 5:
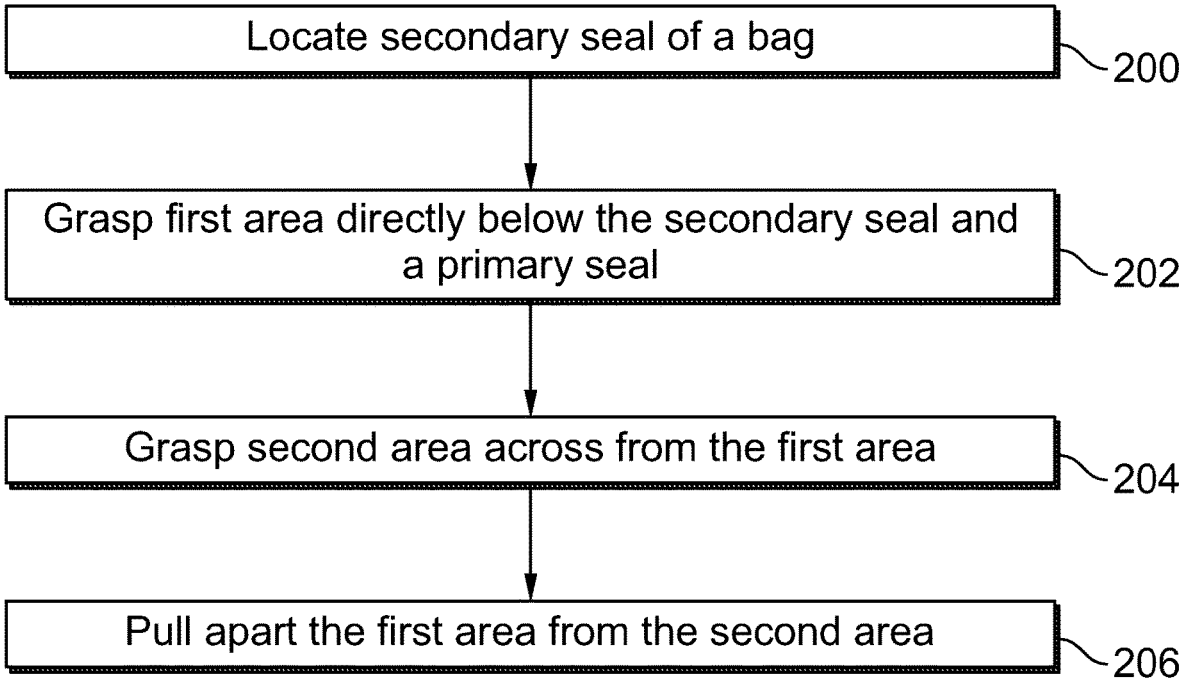
FIG. 5 illustrates a flow chart of a method of opening a child-resistant reclosable bag, according to an embodiment of the present disclosure.

FIG. 5 illustrates a flow chart of a method of opening a child-resistant reclosable bag, according to an embodiment of the present disclosure. Referring to FIGS. 1-5, at 200, the secondary seal 118 is located on the bag 100. The secondary seal 118 identifies the opening areas 119*a* and 119*b*. For example, the secondary seal 118 can directly identify the opening areas 119*a* and 119*b*, such as through the opening indicia 148, as described above. As another example, the secondary seal 118 can indirectly identify the opening areas 119*a* and 119*b*, such as by being at the location above the opening areas 119*a* and 119*b*.

At 202, an individual grasps the first opening area 119*a*, which is directly below the secondary seal 118 and the primary seal 115. At 204, the individual grasps the second opening area 119*b*, which is across from the first opening area 119*a*. For example, the second opening area 119*b* is on the face 130 directly across from the first opening area 119*a* on the opposite face 132. At 206, the individual then pulls apart the first opening area 119*a* from the second opening area 119*b* to open the zipper 110, and therefore the bag 100, as described herein.

Figure 6:
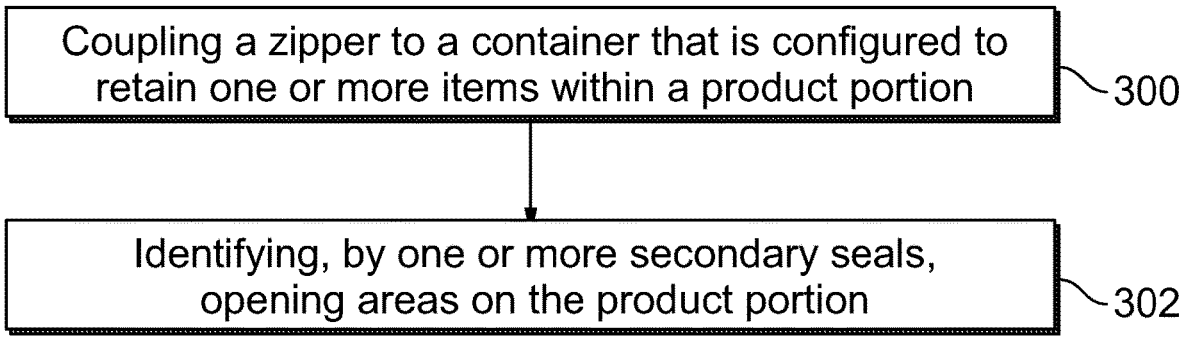
FIG. 6 illustrates a flow chart of a method for forming a child-resistant reclosable bag, according to an embodiment of the present disclosure.

FIG. 6 illustrates a flow chart of a method for forming a child-resistant reclosable bag, according to an embodiment of the present disclosure. The method includes coupling, at 300, a zipper to a container that is configured to retain one or more items within a product portion, wherein the zipper is above the product portion, and wherein the zipper comprises one or more primary seals and one or more secondary seals at one or more defined locations. The method also includes identifying, at 302, by the one or more secondary seals, opening areas on the product portion, wherein the opening areas are configured to be grasped and pulled apart to open the zipper. In at least one embodiment, the method also includes designating, by opening indicia, the opening areas.

Further, the disclosure comprises examples according to the following clauses:

Clause 1. A child-resistant reclosable bag, comprising:

a container configured to retain one or more items within a product portion; and a zipper coupled to the container, wherein the zipper is above the product portion, and wherein the zipper comprises:

one or more primary seals; and one or more secondary seals at one or more defined locations, wherein the one or more secondary seals at the one or more defined locations identify opening areas on the product portion, and wherein the opening areas are configured to be grasped and pulled apart to open the zipper.

Clause 2. The child-resistant reclosable bag of Clause 1, wherein the zipper is disposed between the product portion and a consumer portion.

Clause 3. The child-resistant reclosable bag of Clauses 1 or 2, wherein the one or more primary seals extend along an entire width of the container, and wherein the one or more secondary seals extend along less than the entire width of the container.

Clause 4. The child-resistant reclosable bag of any of Clauses 1-3, wherein the opening areas are below the zipper.

Clause 5. The child-resistant reclosable bag of any of Clauses 1-4, wherein at least one of the opening areas is directly below the one or more secondary seals and the one or more primary seals.

Clause 6. The child-resistant reclosable bag of Clause 5, wherein the at least one of the opening area is directly underneath a center of the one or more secondary seals.

Clause 7. The child-resistant reclosable bag of any of Clauses 1-6, wherein the opening areas have a first width, wherein the one or more secondary seals have a second width, and wherein the first width equals the second width.

Clause 8. The child-resistant reclosable bag of any of Clauses 1-7, wherein the opening areas comprise:

a first opening area on a first face of the container on the product portion; and a second opening area on a second face of the container on the product portion.

Clause 9. The child-resistant reclosable bag of Clause 8, wherein the first opening area is directly across from the second opening area.

Clause 10. The child-resistant reclosable bag of any of Clauses 1-9, further comprising opening indicia that designate the opening areas.

Clause 11. The child-resistant reclosable bag of Clause 10, wherein the one or more secondary seals comprise the opening indicia.

Clause 12. A method of forming a child-resistant reclosable bag, the method comprising:

coupling a zipper to a container that is configured to retain one or more items within a product portion, wherein the zipper is above the product portion, and wherein the zipper comprises one or more primary seals and one or more secondary seals at one or more defined locations; and identifying, by the one or more secondary seals, opening areas on the product portion, wherein the opening areas are configured to be grasped and pulled apart to open the zipper.

Clause 13. The method of Clause 12, wherein the zipper is disposed between the product portion and a consumer portion.

Clause 14. The method of Clauses 12 or 13, wherein the one or more primary seals extend along an entire width of the container, and wherein the one or more secondary seals extend along less than the entire width of the container.

Clause 15. The method of any of Clauses 12-14, wherein the opening areas are below the zipper.

Clause 16. The method of any of Clauses 12-15, wherein at least one of the opening areas is directly below the one or more secondary seals and the one or more primary seals.

Clause 17. The method of any of Clauses 12-16, wherein the opening areas comprise:

a first opening area on a first face of the container on the product portion; and a second opening area on a second face of the container on the product portion.

Clause 18. The method of Clause 17, wherein the first opening area is directly across from the second opening area.

Clause 19. The method of any of Clauses 12-18, further comprising designating, by opening indicia, the opening areas.

Clause 20. A child-resistant reclosable bag, comprising:

a container configured to retain one or more items within a product portion;

opening indicia that designate opening areas; and a zipper coupled to the container, wherein the zipper is disposed between the product portion and the consumer portion, wherein the zipper is above the product portion, and wherein the zipper comprises:

one or more primary seals extending along an entire width of the container; and one or more secondary seals at one or more defined locations, wherein the one or more secondary seals extend along less than the entire width of the container, wherein the one or more secondary seals at the one or more defined locations identify the opening areas below the zipper on the product portion, and wherein the opening areas are configured to be grasped and pulled apart to open the zipper.

Clause 21. The child-resistant reclosable bag of claim 21, wherein the one or more primary seals have a first width, wherein the one or more secondary seals have a second width, and wherein second width is less than the first width.

As described herein, embodiments of the present disclosure provide a child-resistant reclosable bag that is not easily opened. Embodiments of the present disclosure provide child-resistant reclosable bags that are less susceptible to being inadvertently opened. Further, embodiments of the present disclosure provide a child-resistant reclosable bags having a smaller area configured to be engaged for opening the bag, in contrast to any location across the width of the bag.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A child-resistant reclosable bag, comprising:

a container configured to retain one or more items within a product portion; and a zipper coupled to the container, wherein the zipper is above the product portion, and wherein the zipper comprises:

one or more primary seals extending along an entire width of the container; and one or more secondary seals at one or more defined locations, wherein the one or more secondary seals extend along less than the entire width of the container, wherein the one or more secondary seals at the one or more defined locations identify opening areas on the product portion, and wherein the opening areas are configured to be grasped and pulled apart to open the zipper.

2. The child-resistant reclosable bag of claim 1, wherein the zipper is disposed between the product portion and a consumer portion.

3. The child-resistant reclosable bag of claim 1, wherein the opening areas are below the zipper.

4. The child-resistant reclosable bag of claim 1, wherein at least one of the opening areas is directly below the one or more secondary seals and the one or more primary seals.

5. The child-resistant reclosable bag of claim 4, wherein the at least one of the opening area is directly underneath a center of the one or more secondary seals.

6. The child-resistant reclosable bag of claim 1, wherein the opening areas have a first width, wherein the one or more secondary seals have a second width, and wherein the first width equals the second width.

7. The child-resistant reclosable bag of claim 1, wherein the opening areas comprise:

a first opening area on a first face of the container on the product portion; and a second opening area on a second face of the container on the product portion.

8. The child-resistant reclosable bag of claim 7, wherein the first opening area is directly across from the second opening area.

9. The child-resistant reclosable bag of claim 1, further comprising opening indicia that designate the opening areas.

10. The child-resistant reclosable bag of claim 9, wherein the one or more secondary seals comprise the opening indicia.

11. A method of forming a child-resistant reclosable bag, the method comprising:

coupling a zipper to a container that is configured to retain one or more items within a product portion, wherein the zipper is above the product portion, wherein the zipper comprises one or more primary seals and one or more secondary seals at one or more defined locations, wherein the one or more primary seals extend along an entire width of the container, and wherein the one or more secondary seals extend along less than the entire width of the container; and identifying, by the one or more secondary seals, opening areas on the product portion, wherein the opening areas are configured to be grasped and pulled apart to open the zipper.

12. The method of claim 11, wherein the zipper is disposed between the product portion and a consumer portion.

13. The method of claim 11, wherein the opening areas are below the zipper.

14. The method of claim 11, wherein at least one of the opening areas is directly below the one or more secondary seals and the one or more primary seals.

15. The method of claim 11, wherein the opening areas comprise:

a first opening area on a first face of the container on the product portion; and a second opening area on a second face of the container on the product portion.

16. The method of claim 15, wherein the first opening area is directly across from the second opening area.

17. The method of claim 11, further comprising designating, by opening indicia, the opening areas.

18. A child-resistant reclosable bag, comprising:

a container configured to retain one or more items within a product portion;

opening indicia that designate opening areas; and a zipper coupled to the container, wherein the zipper is disposed between the product portion and a consumer portion, wherein the zipper is above the product portion, and wherein the zipper comprises:

one or more primary seals extending along an entire width of the container; and one or more secondary seals at one or more defined locations, wherein the one or more secondary seals extend along less than the entire width of the container, wherein the one or more secondary seals at the one or more defined locations identify the opening areas below the zipper on the product portion, and wherein the opening areas are configured to be grasped and pulled apart to open the zipper.

19. The child-resistant reclosable bag of claim 18, wherein the one or more primary seals have a first width, wherein the one or more secondary seals have a second width, and wherein the second width is less than the first width.

20. The child-resistant reclosable bag of claim 18, wherein at least one of the opening areas is directly below the one or more secondary seals and the one or more primary seals.

* * * * *